US010508428B2

(12) United States Patent
Elliott et al.

(10) Patent No.: US 10,508,428 B2
(45) **Date of Patent: *Dec. 17, 2019**

(54) DRAIN CLEARING DEVICE

(71) Applicant: TTI (MACAO COMMERCIAL OFFSHORE) LIMITED, Macau (MO)

(72) Inventors: Halle Elliott, Greenville, SC (US); Parke Pleasants, Overland Park, KS (US); Julia H. Moylan, Anderson, SC (US); James A. Keith, Pickens, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 0 days.

This patent is subject to a terminal disclaimer.

(21) Appl. No.: 16/031,000

(22) Filed: Jul. 10, 2018

(65) Prior Publication Data

US 2018/0313071 A1 Nov. 1, 2018

Related U.S. Application Data

(63) Continuation of application No. 14/817,858, filed on Aug. 4, 2015, now Pat. No. 10,047,508.

(51) Int. Cl.
*E03C 1/302* (2006.01)
*B08B 9/04* (2006.01)

(52) U.S. Cl.
CPC ..... *E03C 1/302* (2013.01); *B08B 9/04* (2013.01)

(58) Field of Classification Search
CPC .. E03C 1/302; B08B 9/04; E03F 9/002; E03F 9/005
See application file for complete search history.

(56) References Cited

U.S. PATENT DOCUMENTS

| | | | |
|---|---|---|---|
| 834,135 | A | 10/1906 | Hymes |
| 1,825,851 | A | 10/1931 | Bropson |
| 5,769,960 | A | 6/1998 | Nirmel |
| 5,836,032 | A | 11/1998 | Hondo |
| D435,944 | S | 1/2001 | Luoma |
| 6,470,525 | B1 | 10/2002 | Silverman |
| 6,775,873 | B2 | 8/2004 | Luoma |
| 6,898,807 | B2 | 5/2005 | Tash |
| D518,252 | S | 3/2006 | Wu |
| 7,124,450 | B2 | 10/2006 | Davidson |
| 7,523,510 | B1 | 4/2009 | Biagi et al. |

(Continued)

*Primary Examiner* — Janie M Loeppke
(74) *Attorney, Agent, or Firm* — Michael Best & Friedrich LLP

(57) ABSTRACT

A drain clearing device includes an elongated shaft having a first end and a second end opposite the first end. The elongated shaft has a first set of barbs spaced apart along a length of the shaft on a first side of the shaft between the first and second ends and a second set of barbs spaced apart along the length of the shaft on a second side of the shaft between the first and second ends. The drain clearing device further includes a collecting member having a fixed end and a free end. The fixed end is coupled to the elongated shaft proximate the first end and the free end is movable relative to the fixed end from a collapsed position to an extended position, in which the elongated shaft is substantially surrounded by the collecting member. The collecting member is configured to contain debris from a drain.

23 Claims, 11 Drawing Sheets

(56) References Cited

U.S. PATENT DOCUMENTS

| | | | | |
|---|---|---|---|---|
| 7,584,513 | B2 | 9/2009 | Turner | |
| D610,761 | S | 2/2010 | Gengler et al. | |
| D639,623 | S | 6/2011 | Tash | |
| 8,020,223 | B2 | 9/2011 | Falcon et al. | |
| D649,307 | S | 11/2011 | Zach et al. | |
| 8,359,696 | B1 | 1/2013 | Turner et al. | |
| 8,584,297 | B2 | 11/2013 | Tash | |
| D706,004 | S | 5/2014 | Dennis et al. | |
| 8,739,968 | B2 | 6/2014 | Bates et al. | |
| 2009/0049593 | A1* | 2/2009 | Hodkiewicz ..... | E03C 1/308 4/255.05 |
| 2010/0000010 | A1 | 1/2010 | Martinisko | |
| 2014/0325747 | A1 | 11/2014 | Gwen | |

* cited by examiner

DRAIN CLEARING DEVICE

CROSS-REFERENCE TO RELATED APPLICATIONS

This application is a continuation of U.S. patent application Ser. No. 14/817,858, filed on Aug. 4, 2015, the entire contents of which are incorporated herein by reference.

BACKGROUND

The present invention relates to drain clearing devices, and particularly to manual drain clearing devices.

Drain cleaners and drain uncloggers are generally known, and typically include some type of elongated shaft or cable that is inserted into a drain. The elongated shaft is used to collect debris, such as hair, dirt, and other material, that is caught in the drain causing fluid back up. The debris attaches to the elongated shaft and is removed by pulling the elongated shaft out of the drain. Oftentimes the fluid and debris drips or falls off of the elongated shaft, creating a mess around the drain area. In other instances, the user must remove the debris from the elongated shaft using their hands.

SUMMARY

In one embodiment, the invention provides a drain clearing device including an elongated shaft having a first end and a second end, and a collecting member having a fixed end and a free end. The fixed end is coupled to the elongated shaft proximate the first end, and the free end is movable relative to the fixed end from a collapsed position to an extended position, in which the elongated shaft is substantially surrounded by the collecting member.

In another embodiment, the invention provides a method of clearing a drain using a drain clearing device including an elongated shaft and a collecting member, the elongated shaft having a first end, a second end, and a plurality of barbs protruding outward from the elongated shaft, the collecting member having a fixed end and a free end, the fixed end coupled to the elongated shaft proximate the first end, the free end movable relative to the fixed end from a collapsed position to an extended position, in which the elongated shaft is substantially surrounded by the collecting member. The method includes inserting the elongated shaft into a drain, removing the elongated shaft from the drain, and moving the collecting member from the collapsed position to the extended position as the elongated shaft is removed from the drain.

In yet another embodiment, the invention provides a drain clearing device including an elongated shaft having a first end, a second end, a plurality of barbs protruding outward from the elongated shaft between the first and second ends, a first retaining member extending from the first end, and a second retaining member spaced from the first retaining member and extending from the first end, the second end configured to be inserted into a drain. The drain clearing device further includes a spool coupled to the elongated shaft proximate the first end, such that the spool includes a slot that receives the elongated shaft. The spool is rotatable between a locked position, in which the spool is captured between the first and second retaining members, and an unlocked position, in which the spool is removable from the elongated shaft. The drain clearing device further includes a collecting member having a fixed end and a free end, where the fixed end is secured to the spool. The free end movable is relative to the fixed end from a collapsed position, in which the free end is proximate the first end of the elongated shaft and the elongated shaft is substantially exposed, to an extended position, in which the free end is proximate the second end of the elongated shaft and the collecting member substantially surrounds the elongated shaft. A rigid ring is coupled to the free end of the collecting member, such that the rigid ring holds the collecting member open around the elongated shaft.

Other aspects of the invention will become apparent by consideration of the detailed description and accompanying drawings.

Figure 1:
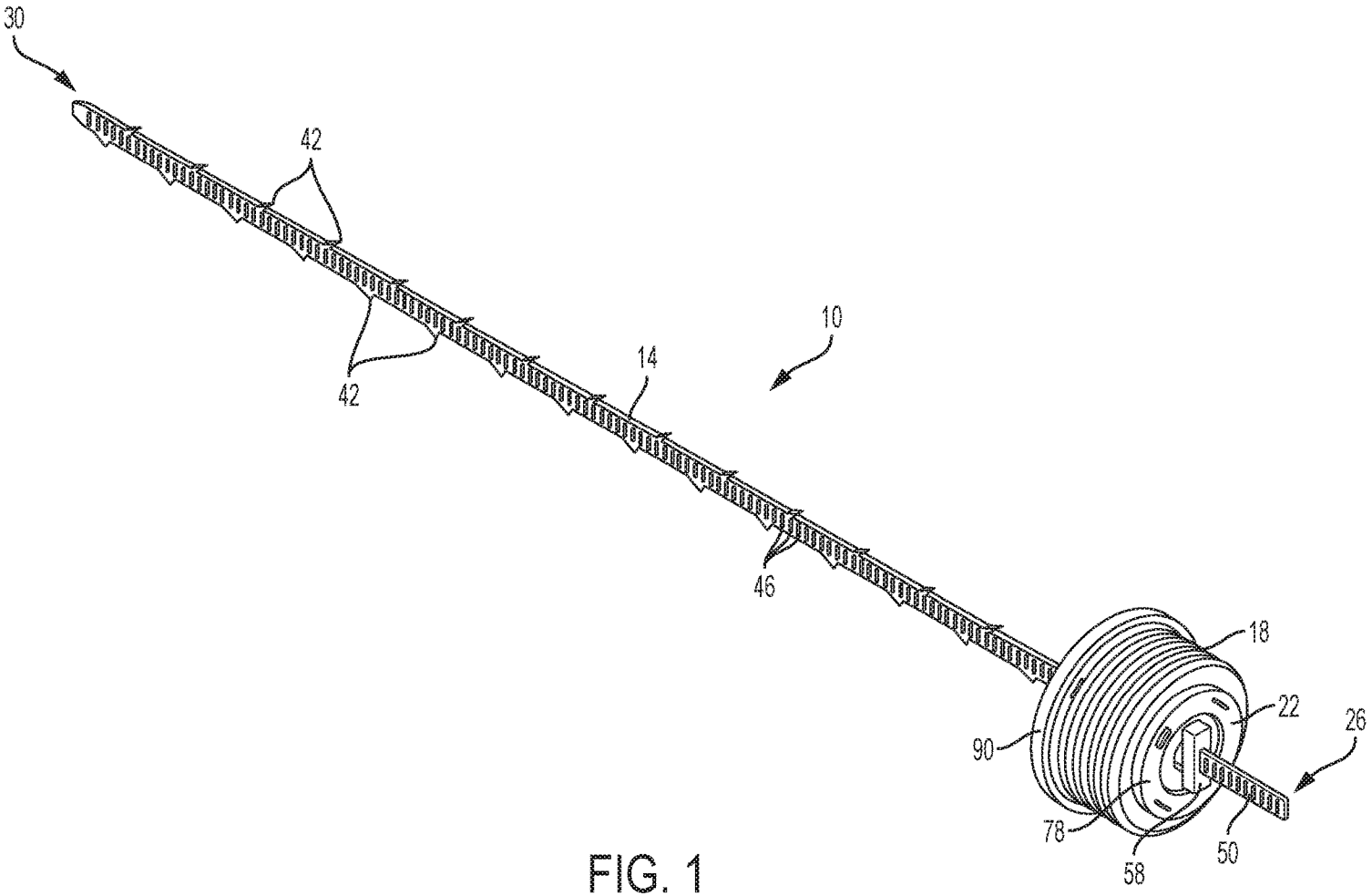
FIG. 1 is a perspective view of a drain clearing device embodying the invention, the drain clearing device including a collecting member in a collapsed position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

FIGS. 1-4 illustrate a drain clearing device 10 according to one embodiment of the invention. The drain clearing device 10 includes an elongated shaft 14, a collecting member 18, and a spool 22 coupling the collecting member 18 to the elongated shaft 14. The elongated shaft 14 includes a first end 26 and a second end 30. The second end 30 is configured to be inserted into a drain. The elongated shaft 14 is composed of a flexible material (e.g. plastic) that enables the elongated shaft 14 to flex or bend to contours of the drain. The illustrated elongated shaft 14 has a generally rectangular cross-section having two opposing flat faces 34 and two narrower side faces 38. However, the shaft 14 can include any flexible drain clearing shafts known in the art. For example, in some embodiments the shaft 14 can be cylindrical, a helical coil, a tubular shaft with a bulbous end, or other shapes. The shaft 14 can include various components to gather debris from inside the drain, such as barbs, hooks, velcro, bristles, or an adhesive coating. The shaft 14 can also be composed of various materials including, but not limited to, plastic, rubber, velcro, metal, or wire.

Figure 5:
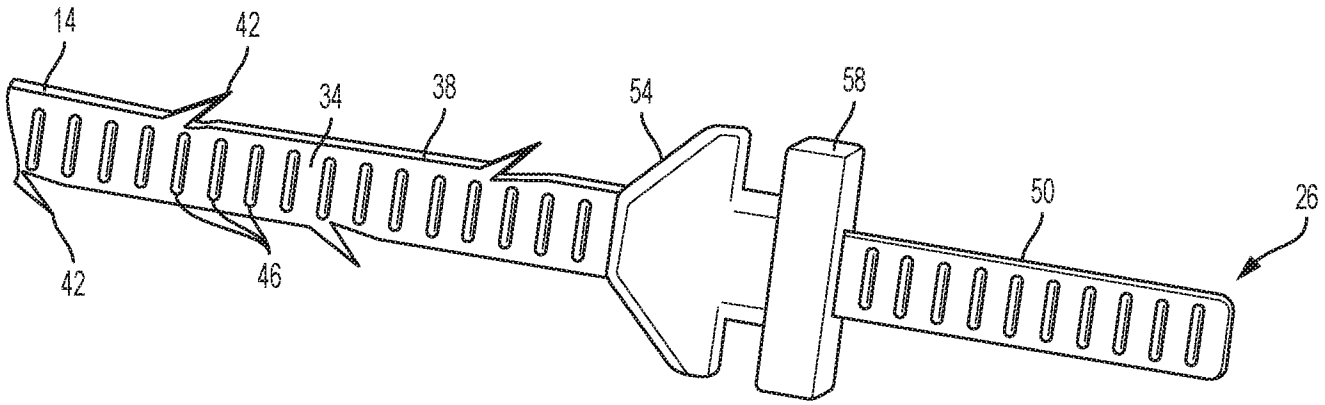
FIG. 5 is an enlarged view of a portion of an elongated shaft of the drain clearing device.

With reference to FIG. 5, the illustrated elongated shaft 14 includes outwardly protruding barbs 42. The barbs 42 are positioned along the side faces 38 of the elongated shaft 14 between the first and second ends 26, 30. In the illustrated embodiment, the barbs 42 are off-set such that they form an alternating pattern. However, the barbs 42 can be arranged in other patterns on the elongated shaft 14, or in some instances, the elongated shaft 14 may not include barbs 42. Additionally, the opposing flat faces 34 include ridges 46 along the length of the flat faces 34. The ridges 46 provide an additional textured surface for collecting debris within the drain.

The elongated shaft 14 includes a gripping section 50 on the first end 26 of the elongated shaft 14. The gripping section 50 allows a user to hold the elongated shaft 14 as the shaft 14 is inserted into and removed from the drain. The illustrated drain clearing device 10 does not include barbs 42 on the gripping section 50.

As shown in FIG. 5, the illustrated elongated shaft 14 also includes a first retaining member 54 and a second retaining member 58. The retaining members 54, 58 are disposed on the elongated shaft 14 proximate the first end 26 and the gripping section 50. The first and second retaining members 54, 58 extend from the elongated shaft 14 in a direction generally perpendicular to a longitudinal axis of the elongated shaft 14. The first and second retaining members 54, 58 are spaced apart from each other. In the illustrated embodiment the first and second retaining members 54, 58 are opposing flanges that form a T with the elongated shaft 14. The first and second retaining members 54, 58 assist in attaching the collecting member 18 and the spool 22 to the elongated shaft 14.

FIG. 5 illustrates one example of a retaining member 54, 58, however, other types of retaining members may be used to couple the collecting member 18 to the elongated shaft 14. For example, in some embodiments, the retaining members 54, 48 may only have one flange, may be circular, or may form an L with the elongated shaft 14. In other embodiments, only one retaining member may be used to couple the spool 22 to the elongated shaft 14. Additionally, some embodiments may include a retaining member that uses a snap on assembly.

With reference to FIGS. 1-4, the collecting member 18 is coupled to the elongated shaft 14. The collecting member 18 is composed of a flexible material such as, for example, rubber or plastic. The collecting member 18 may be clear/transparent or opaque. In some embodiments, the collecting member 18 is stretchy or expandable. In the illustrated embodiment, the collecting member 18 is a disposable bag, similar to a plastic shopping bag.

Figure 3:
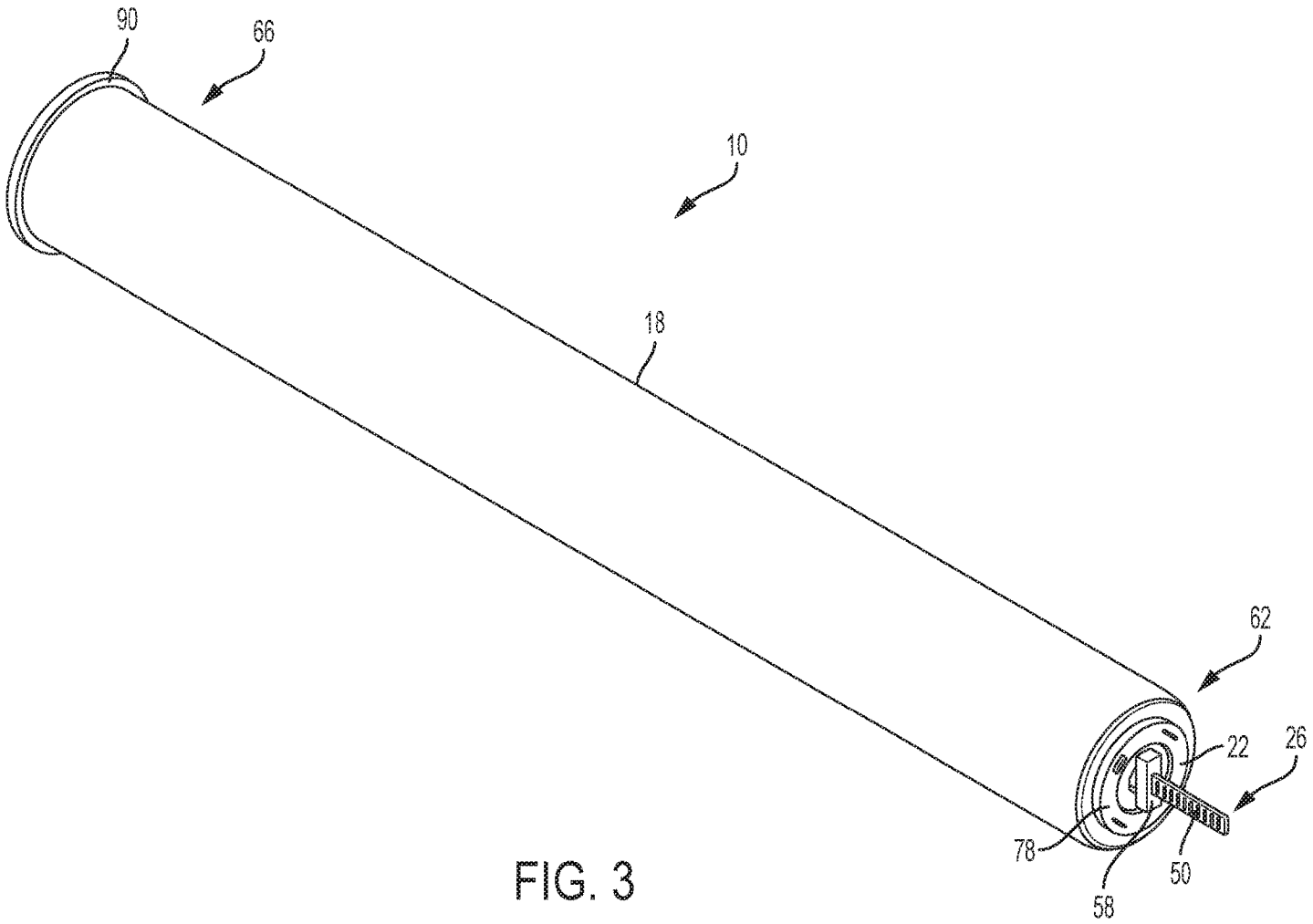
FIG. 3 is a perspective view of the drain clearing device with the collecting member in an extended position.
Figure 4:
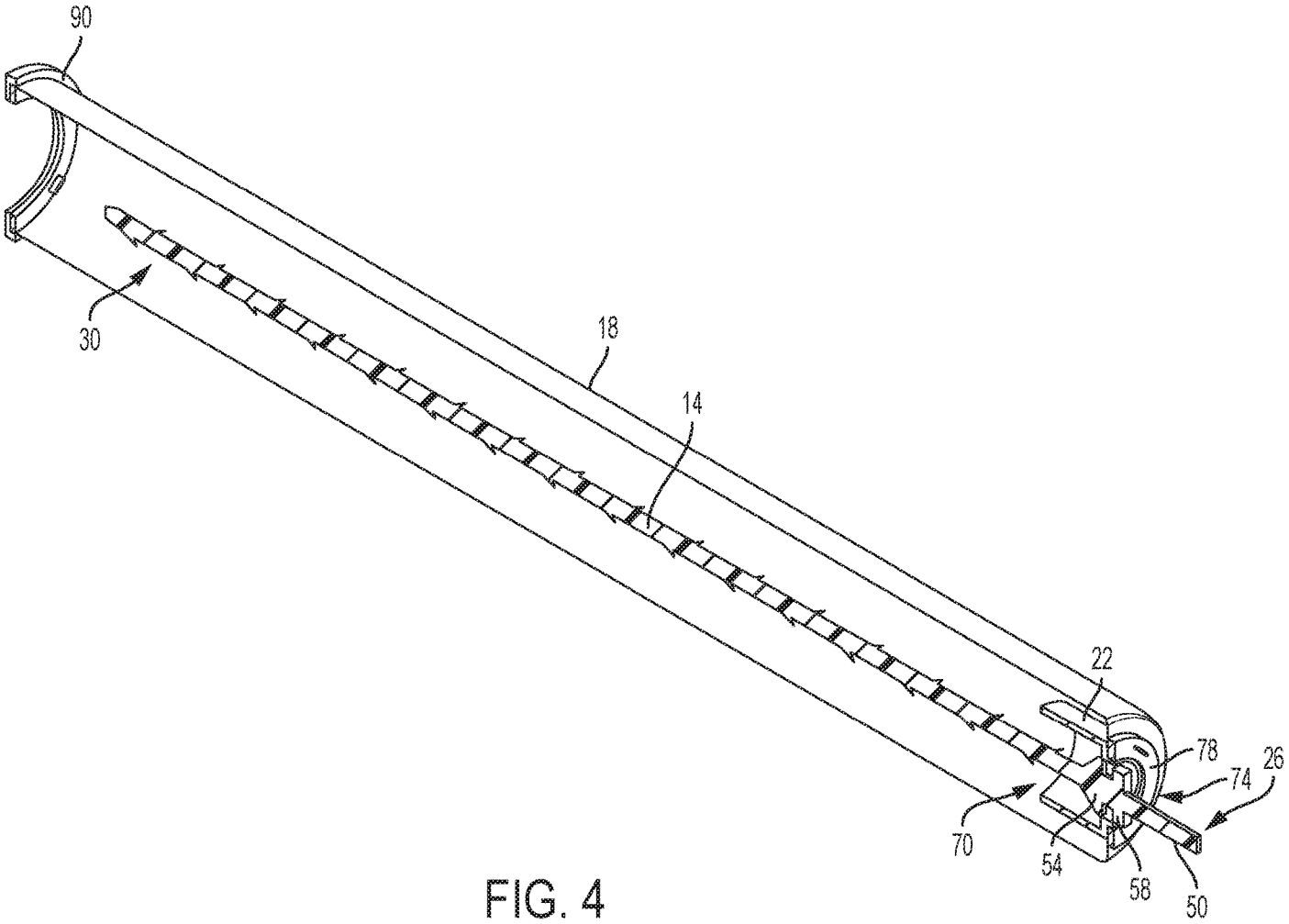
FIG. 4 is a cross-sectional view of the drain clearing device with the collecting member in the extended position.

The collecting member 18 includes a fixed end 62 and a free end 66. The fixed end 62 of the collecting member 18 is coupled proximate the first end 26 of the elongated shaft 14 (i.e., the collecting member 18 is closer to the first end 26 than the second end 30). The collecting member 18 is concentric with the elongated shaft 14. The free end 66 of the collecting member 18 is capable of moving relative to the fixed end 62 from a collapsed position, as shown in FIG. 1, to an extended position, as shown in FIGS. 3 and 4. When the collecting member 18 is in the collapsed position, the free end 66 is positioned proximate the first end 26 of the elongated shaft 14 (i.e., the free end 66 is closer to the first end 26 than to the second end 30 of the shaft 14). In this position, the elongated shaft 14 is exposed. Additionally, the collecting member 18 is compact and does not interfere with the insertion of the elongated member 14 into a drain. When the collecting member 18 is in the extended position, the free end 66 is positioned proximate the second end 30 of the elongated shaft 14 (i.e., the free end 62 is closer to the first end 26 than to the second end 30 of the shaft 14). In this position, the collecting member 18 substantially surrounds the elongated shaft 14. The collecting member 18 conceals the elongated shaft 14 as the elongated shaft 14 is retracted from the drain. Specifically, the elongated shaft 14 retracts into the collecting member 18. Thus, the collecting member 18 covers the debris collected from the drain by the elongated shaft 14 so that the debris can be easily discarded without creating a mess near the drain area. In the illustrated embodiment, the collecting member 18 is coupled to the elongated shaft 14 by the spool 22.

With reference to FIGS. 6-9, the spool 22 includes a cylindrical body having an open end 70 and a closed end 74. The closed end 74 includes a fixed ring 78 that attaches the collecting member to the spool 22. In the illustrated embodiment, the fixed ring 78 is coupled to the closed end 74 of the spool 22. In other embodiments, the fixed ring 78 can be positioned in the middle or on the open end 70 of the spool 22. The fixed ring 78 is used to secure the collecting member 18 to the spool 22 by pinching the collecting member 18 between the fixed ring 78 and the spool 22. Although the illustrated embodiment shows a cylindrical spool 22 and a circular ring 78, other shapes can be used. For example, the spool 22 can be rectangular or cubical, and the ring can be triangular or organically shaped.

The closed end 74 of the spool 22 further includes an end (or end face) surface 82 having a slot 86, which receives the elongated shaft 14. When the elongated shaft 14 is received by the slot 86, the spool 22 can engage with the first and second retaining members 54, 58 of the elongated shaft 14 to couple the spool 22 to the elongated shaft 14. The slot 86 and the first and second retaining members 54, 58 enable the spool 22 to be locked and unlocked to the elongated shaft 14.

Figure 6:
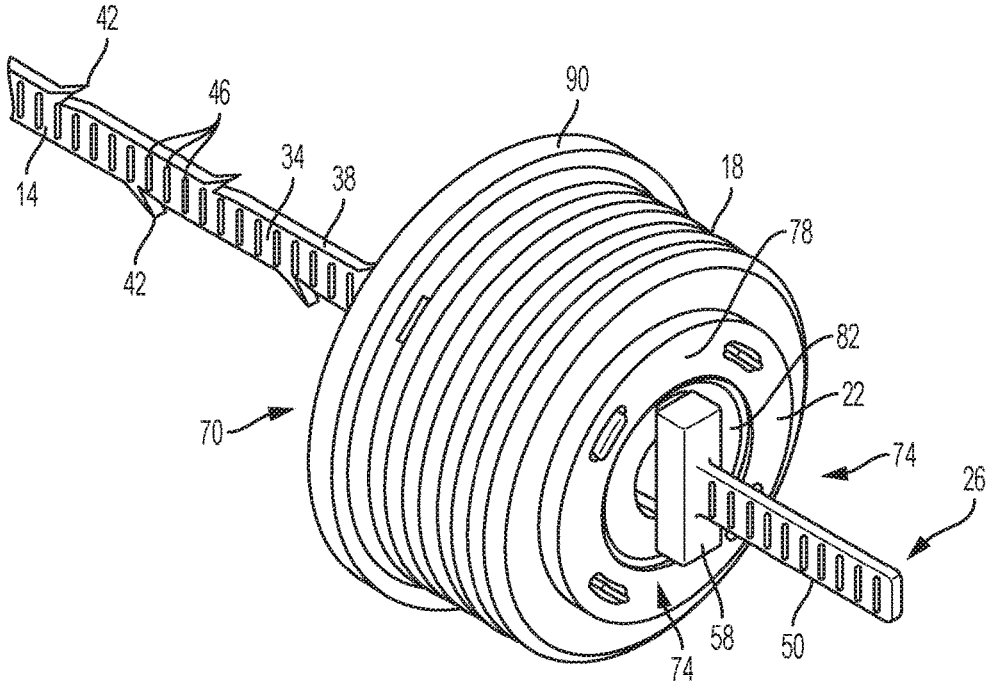
FIG. 6 is an enlarged, perspective view of the elongated shaft and the spool of the drain clearing device in an unlocked position.
Figure 7:
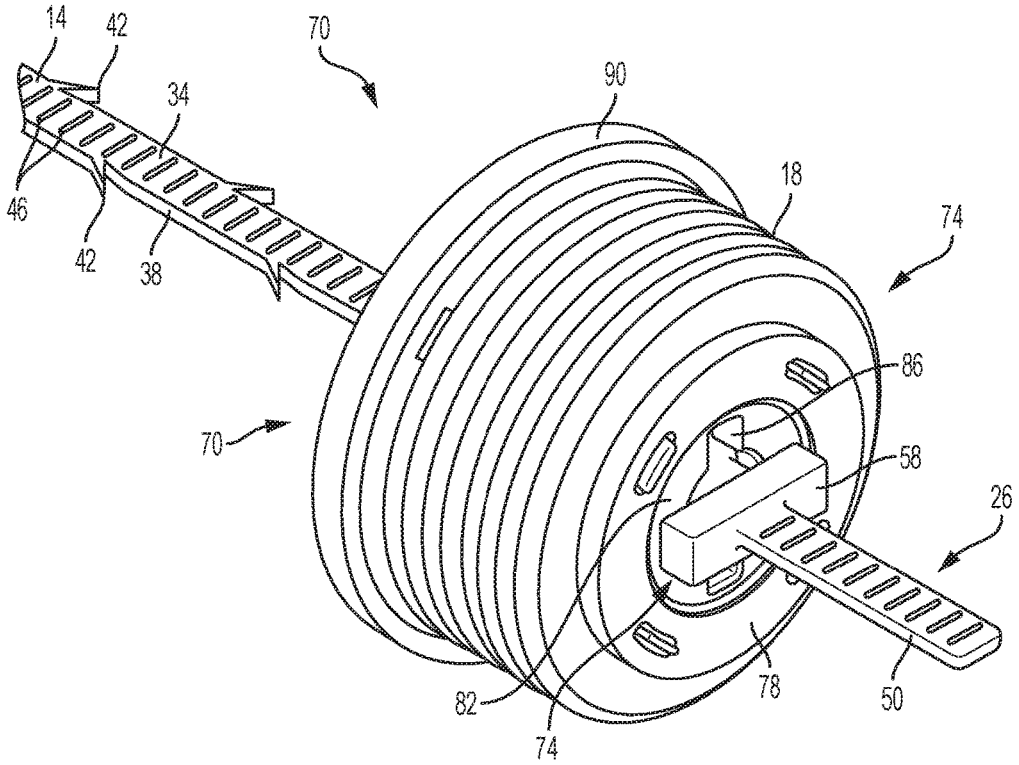
FIG. 7 is an enlarged, perspective view of the elongated shaft and the spool in a locked position.
Figure 8:
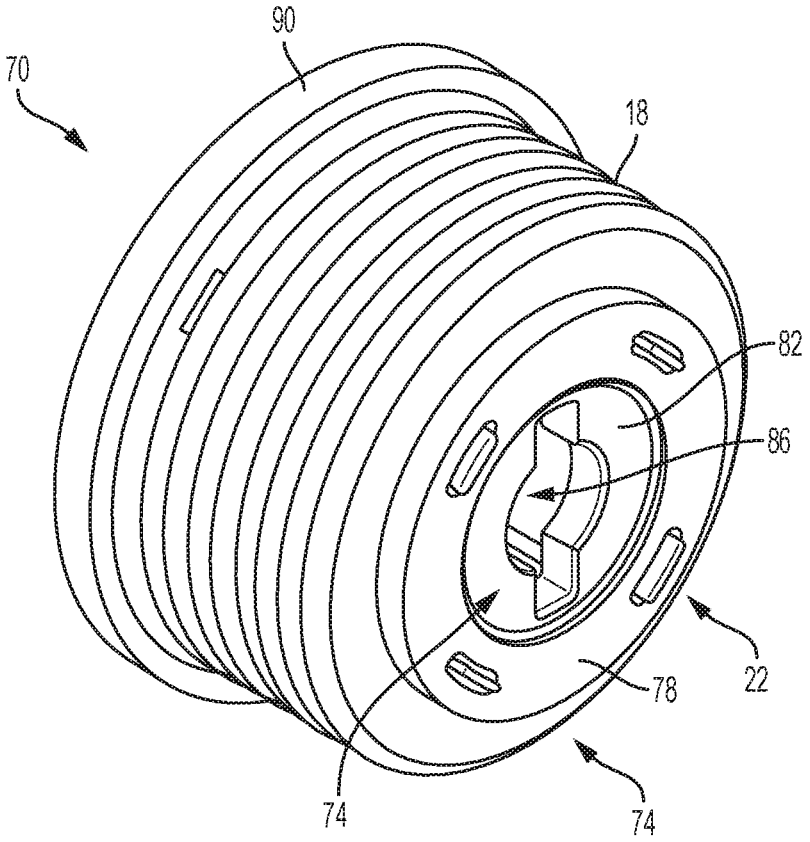
FIG. 8 is a perspective view of the spool and the collecting member.
Figure 9:
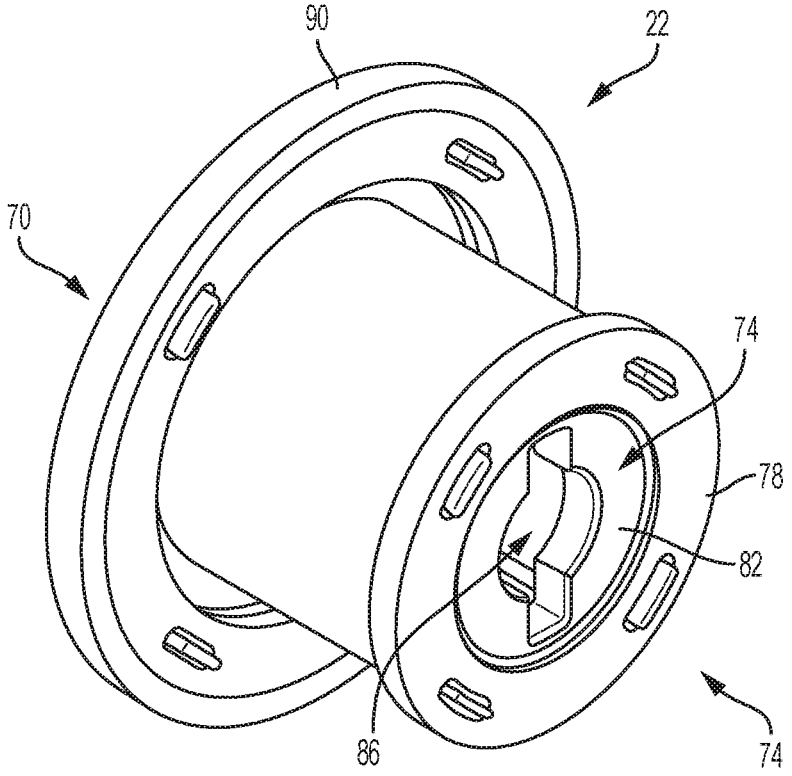
FIG. 9 is a perspective view of the spool without the collecting member.

The elongated shaft 14 is inserted through the slot 86 until one of the retaining members 54, 58 passes the slot 86. This is defined as the unlocked position, as shown in FIG. 6. In this position, the spool 22 is not fixed relative to the elongated shaft 14. In order to lock the spool 22 in place along the elongated shaft 14, the spool 22 and the elongated shaft 14 are rotated relative to one another (approximately 90 degrees) until the end surface 82 of the spool 22 is captured between the first and second retaining members 54, 58. In this position, the first and second retaining members 54, 58 are positioned on opposite sides of the end surface 82 in order to hold the spool 22 in a fixed position along the elongated shaft 14. In particular, the first retaining member 54 engages the spool 22 to inhibit movement toward the second end 30. The second retaining member 58 engages the spool 22 to inhibit movement toward the first end 26. This defines the locked position, as shown in FIG. 7. The spool 22 can be removed from the elongated shaft 14 by rotating the spool 22 back to the unlocked position and sliding the elongated shaft 14 out of the slot 86 on the spool 22.

Figure 2:
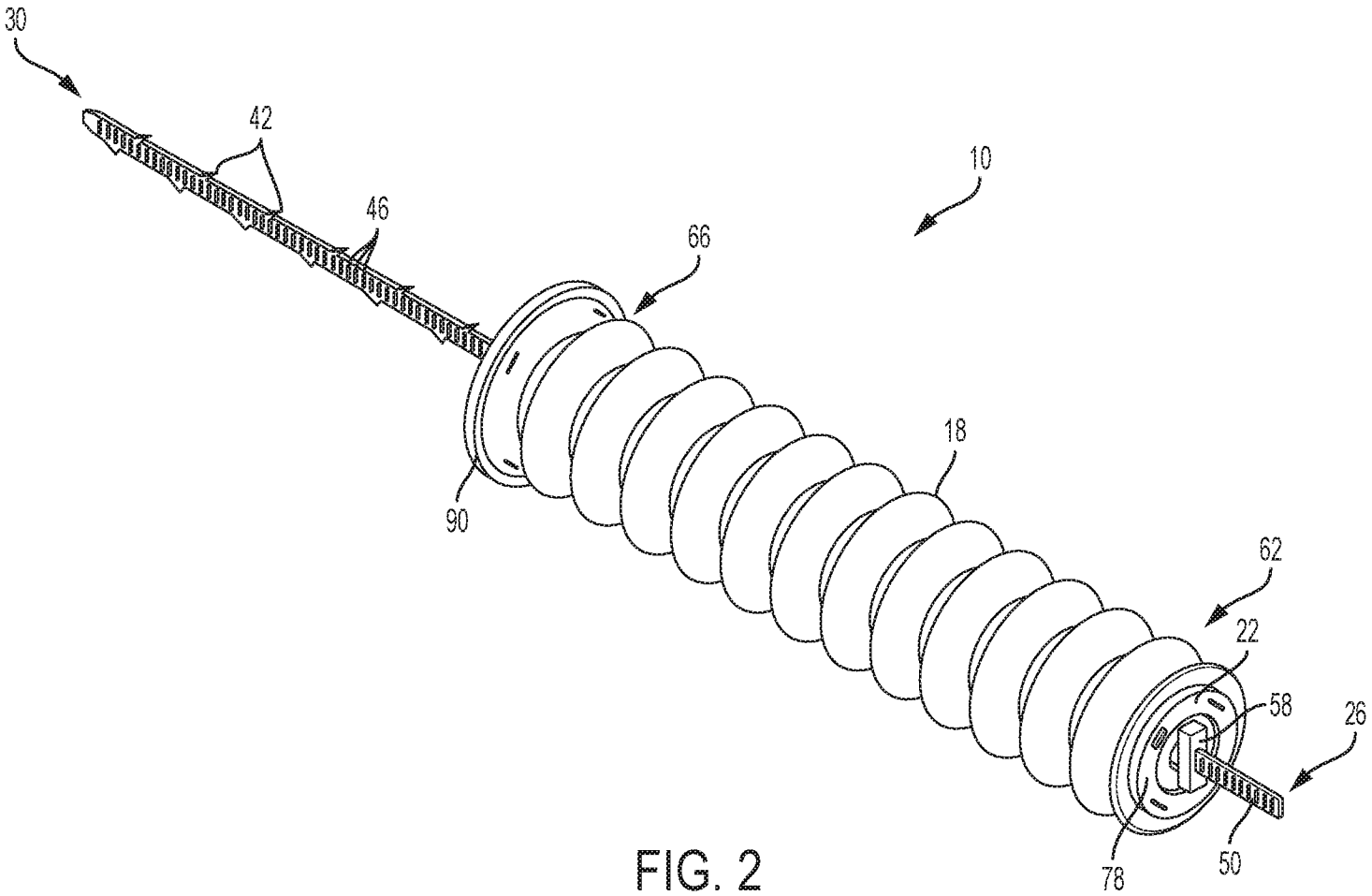
FIG. 2 is a perspective view of the drain clearing device with the collecting member in a partially extended position.

With reference to FIGS. 2-4, the illustrated drain clearing device 10 includes a rigid ring 90 coupled to the free end 66 of the collecting member 18. Similar to the fixed ring 78, the rigid ring 90 is not limited to a circular shape, but can include other shapes, such as a square. The rigid ring 90 is adapted to hold the collecting member 18 open as the free end 66 of the collecting member 18 is moved between the collapsed position and the extended position. Specifically, the rigid ring 90 helps maintain the shape of the collecting member 18 so the collecting member 18 is radially spaced apart from the elongated shaft 14. Additionally, the rigid ring 90 provides a rigid or semi-rigid surface that can be gripped by a user when moving the collecting member 18 between the collapsed position and the extended position.

In operation, the drain clearing device 10 is first assembled by inserting the elongated shaft 14 through the slot 86 on the spool 22. To lock the spool 22 to the elongated shaft 14, the spool 22 is rotated relative to the elongated shaft 14 so that the first and second retaining members 54, 58 engage the spool 22 on opposite sides of the end surface 82 and prohibit movement of the spool 22 along the shaft 14. During this assembly phase, the collecting member 18 is typically in the collapsed position.

Figure 10:
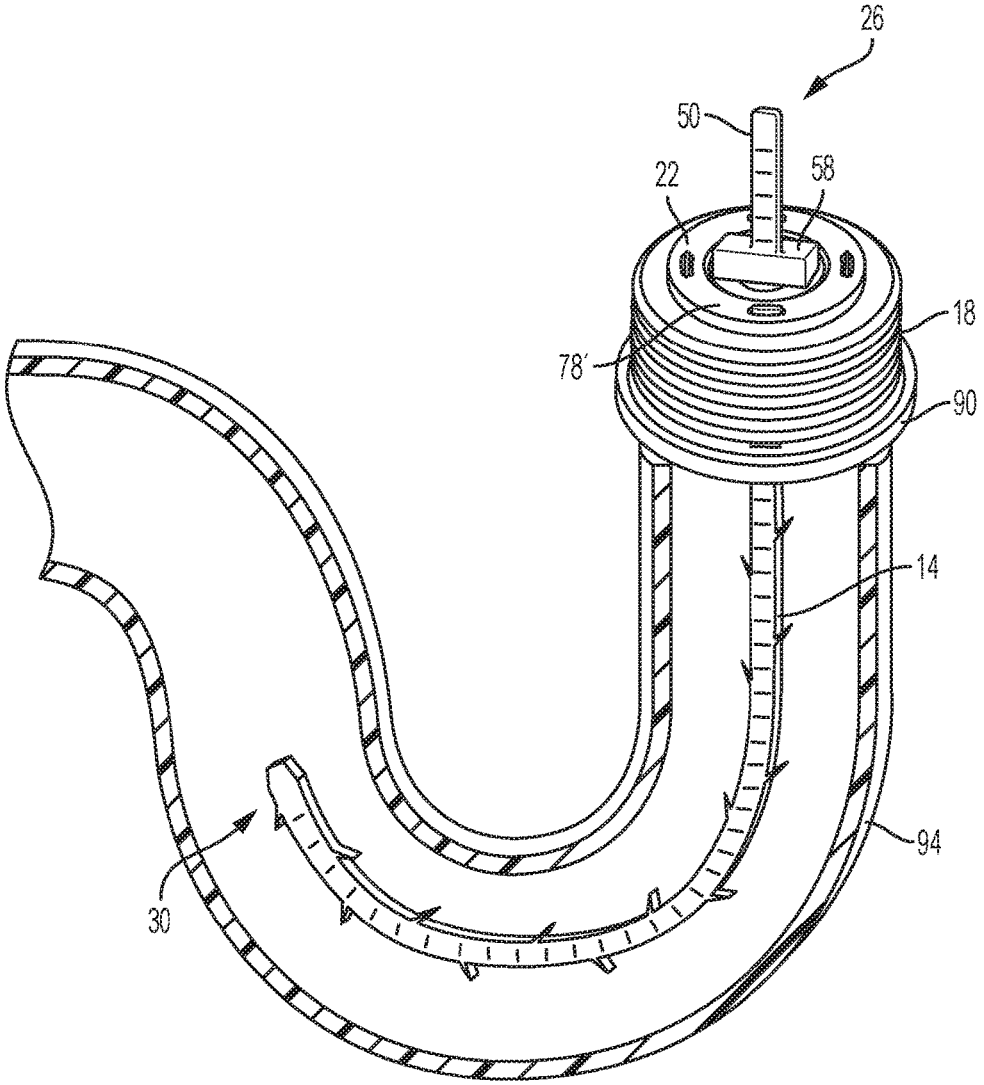
FIG. 10 is a partial cross-sectional view of the drain clearing device extending into a drain.

After the spool 22 and the collecting member 18 are assembled onto the elongated shaft 14, the elongated shaft 14 is inserted into a drain 94 to be cleared. FIG. 10 illustrates the drain clearing device 10 with the elongated shaft 14 fully inserted into the drain 94, and the collecting member 18 in the collapsed position. The elongated shaft 14 can bend through the contours of the drain 94 to collect debris and hair. The barbs 42 and the ridges 46 along the elongated shaft 14 collect the debris.

Figure 11:
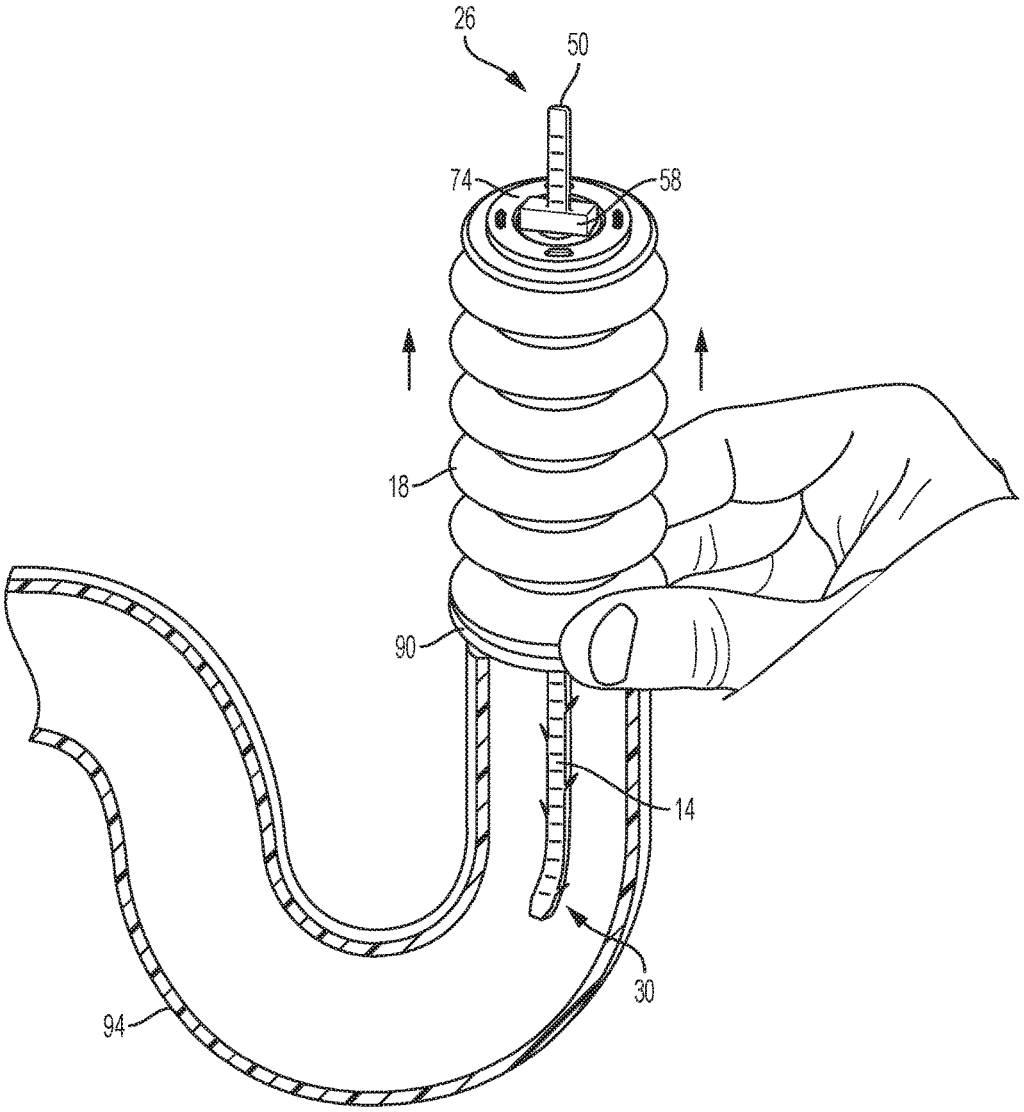
FIG. 11 is a partial cross-sectional view of the drain clearing device being pulled out of the drain and the collecting member in an intermediate position.

As the elongated shaft 14 is removed from the drain 94, the debris and hair are removed along with the elongated shaft 14. FIG. 11 illustrates the drain clearing device 10 being removed from the drain 94 and the collecting member 18 in an intermediate position as the collecting member 18 moves from the collapsed position to the extended position. When removing the elongated shaft 14 from the drain 94, a user holds the rigid ring 90 in place generally against an opening of the drain 94. As the elongated shaft 14 is removed, the collecting member 18 transitions from the collapsed position to the extended position, and the elongated shaft 14 retracts or is pulled into the collecting member 18. The collecting member 18 covers the elongated shaft 14 and contains the debris immediately so that the debris does not create a mess around the drain 94. Additionally, the user does not need to touch the debris with his or her hands. The drain clearing device 10 is disposable and can be thrown away after a single use. In other embodiments, the elongated shaft 14 can be reused multiple times and a new collecting member 18 can be attached for each use.

Although the invention has been described with reference to certain preferred embodiments, variations and modifications exit within the spirit and scope of the present invention. Various features and advantages of the invention are set forth in the following claims.

What is claimed is:

1. A drain clearing device comprising:

an elongated shaft having a first end and a second end opposite the first end, the elongated shaft having a first set of barbs spaced apart along a length of the shaft on a first side of the shaft between the first and second ends and a second set of barbs spaced apart along the length of the shaft on a second side of the shaft between the first and second ends; and a collecting member having a fixed end and a free end, the fixed end coupled to the elongated shaft proximate the first end, the free end movable relative to the fixed end from a collapsed position to an extended position, in which the elongated shaft is substantially surrounded by the collecting member, wherein the collecting member includes a plastic bag that is freely movable between the collapsed position and the extended position, and wherein the collecting member configured to contain debris from a drain.

2. The drain clearing device of claim 1, wherein the second end of the elongated shaft is positioned within the collecting member when in the extended position.

3. The drain clearing device of claim 1, wherein the first and second sides are oppositely facing narrow sides, and wherein the elongated shaft further includes two oppositely facing flat faces.

4. The drain clearing device of claim 3, wherein the elongated shaft further includes ridges along a length of the flat faces.

5. The drain clearing device of claim 1, wherein the collecting member is radially spaced from the elongated shaft when in the extended position such that the collecting member does not contact the second end of the elongated shaft.

6. The drain clearing device of claim 5, wherein the collecting member is substantially concentric with the elongated shaft such that the elongated shaft is surrounded by the collecting member.

7. The drain clearing device of claim 1, further comprising a spool coupled to the elongated shaft proximate the first end, wherein the fixed end of the collecting member is secured to the spool.

8. The drain clearing device of claim 7, wherein the spool includes an opening, and wherein the elongated shaft extends through the opening to couple the spool to the elongated shaft.

9. The drain clearing device of claim 1, further comprising a rigid ring coupled to the free end of the collecting member, wherein the rigid ring holds the collecting member open around the elongated shaft.

10. The drain clearing device of claim 1, wherein the collecting member is a disposable bag.

11. A drain clearing device comprising:

an elongated shaft having a first end, a second end opposite the first end, and a plurality of barbs protruding outward from the elongated shaft; and a collecting member having a fixed end and a free end, the fixed end coupled to the elongated shaft proximate the first end, the free end movable relative to the fixed end over the elongated shaft from a collapsed position, in which the second end of the elongated shaft is exposed, and an extended position, in which the second end of the elongated shaft is positioned within the collecting member;

wherein the collecting member includes a plastic bag that is freely movable between the collapsed position and the extended position.

12. The drain clearing device of claim 11, wherein the collecting member is configured to contain debris collected by the plurality of barbs from a drain.

13. The drain clearing device of claim 11, wherein the collecting member is radially spaced from the elongated shaft when in the extended position such that the collecting member does not contact the second end of the elongated shaft.

14. The drain clearing device of claim 13, wherein the collecting member is substantially concentric with the elongated shaft such that the elongated shaft is surrounded by the collecting member.

15. The drain clearing device of claim 11, further comprising a spool coupled to the elongated shaft proximate the first end, wherein the fixed end of the collecting member is secured to the spool.

16. The drain clearing device of claim 15, wherein the spool includes an opening, and wherein the elongated shaft extends through the opening to couple the spool to the elongated shaft.

17. A method of clearing a drain using a drain clearing device, the drain clearing device including an elongated shaft and a collecting member, the elongated shaft having a first end, a second end, and a plurality of barbs protruding outward from the elongated shaft, the collecting member having a fixed end and a free end, the fixed end coupled to the elongated shaft proximate the first end, the method comprising:

inserting the elongated shaft into a drain;

removing the elongated shaft from the drain;

moving the free end of the collecting member relative to the fixed end from a collapsed position to an extended position, in which the elongated shaft is substantially surrounded by the collecting member, as the elongated shaft is removed from the drain; and containing debris from the drain in the collecting member when in the extended position.

18. The method of claim 17, wherein moving the free end of the collecting member includes maintaining radially spacing of the collecting member from the elongated shaft when in the extended position such that the collecting member does not contact the second end of the elongated shaft.

19. The method of claim 17, wherein the plurality of barbs include a first set of barbs spaced apart along a length of the shaft on a first side of the shaft between the first and second ends and a second set of barbs spaced apart along the length of the shaft on a second side of the shaft between the first and second ends, and further comprising engaging debris in the drain with the first set of barbs, the second set of barbs, or both.

20. The method of claim 17, wherein the drain clearing device further includes a spool having an opening, wherein the fixed end of the collecting member is secured to the spool, and further comprising inserting the elongated shaft through the opening of the spool to couple the collecting member to the elongated shaft.

21. The drain clearing device of claim 1, wherein the first and second sets of barbs are positioned within the collecting member when in the extended position to contain debris collected by the first and second sets of barbs.

22. The method of claim 17, wherein removing the elongated shaft further includes holding a rigid ring in place generally against an opening of the drain as the elongated shaft is removed.

23. The method of claim 17, wherein removing the elongated shaft further includes pulling the elongated shaft into the collecting member.

* * * * *